United States Patent [19]

Acton

[11] 4,017,947

[45] Apr. 19, 1977

[54] CASKET AND CASKET SUPPORT

[75] Inventor: Hugh Collier Acton, Augusta, Mich.

[73] Assignee: Boyertown Burial Casket Company, Boyertown, Pa.

[22] Filed: Oct. 20, 1975

[21] Appl. No.: 624,300

[52] U.S. Cl. ..... 27/27

[51] Int. Cl.[2] ..... A61G 17/00

[58] Field of Search ..... 27/27, 2

[56] References Cited

UNITED STATES PATENTS

| | | | |
|---|---|---|---|
| 737,580 | 9/1903 | Carpenter | 27/27 |
| 937,086 | 10/1909 | Montross | 27/27 |
| 1,224,383 | 5/1917 | Jones | 27/27 |
| 1,292,268 | 1/1919 | DeCamp | 27/27 |
| 2,759,239 | 8/1956 | Snyder | 27/27 |
| 2,802,253 | 8/1957 | Birck | 27/27 |
| 2,946,113 | 7/1960 | Clark | 27/27 |

*Primary Examiner*—John D. Yasko
*Attorney, Agent, or Firm*—Paul & Paul

[57] ABSTRACT

A casket is provided, having a groove extending therearound, near the bottom thereof, and being completely without handles. A carrying device is provided, for engaging in the groove when applied thereto, the carrying device being readily detachable for re-use.

19 Claims, 9 Drawing Figures

CASKET AND CASKET SUPPORT

BACKGROUND OF THE INVENTION

In caskets of prior art types, it has been commonplace to provide handles generally at sides and ends of the caskets, and in some instances the handles had taken the form of elongated bars. However, in prior art types of caskets, the handles or bars are permanently attached to the casket, such that the handles are interred with the casket, or in any event remain with the casket, even if it is permanently disposed in vault or the like.

In a great many instances, for purposes of aesthetics, the handles take the form of rather expensive metal carvings, configurations and the like, often of brass or like quality construction. After interment, the handles serve no use whatever and their expense is thereafter wasted.

THE PRESENT INVENTION

The present invention resides in the use of a casket without handles. In order to provide a device for carrying the casket, and for supporting the casket during its carrying, a re-usable carrying device in the form of a frame having casket-engaging portions is provided. To this end, the casket is provided with a recess, for engagement by casket-engaging portions. These portions are in the form of devices that are readily removeable or dis-connectible from the casket, by unthreading a threaded member, by releasing a guide, or the like. The carrying device may be withdrawn from the casket at the situs of interment for descent into a grave without handles, with the carrying device then being adaptable for re-use.

Accordingly, it is a primary object of this invention to provide a novel casket; one that is handleless.

It is another object of this invention to accomplish the above object, wherein the casket includes a recess for engagement by projecting portions of a casket-carrying device.

It is a further object of this invention to provide a novel re-usable casket-carrying device for engagement with a handleless casket.

It is another object of this invention to provide a novel combination of a casket and a carrying device that is readily disengageable therefrom.

It is a further object of this invention to provide novel dis-connection devices for a casket-carrying structure.

Other objects and advantages of the present invention will be readily apparent to those skilled in the art from a reading of the following brief descriptions of the drawing figures, detailed descriptions of the preferred embodiments, and the appended claims.

BRIEF DESCRIPTIONS OF THE DRAWING FIGURES

DETAILED DESCRIPTIONS OF THE PREFERRED EMBODIMENTS

Figure 1:
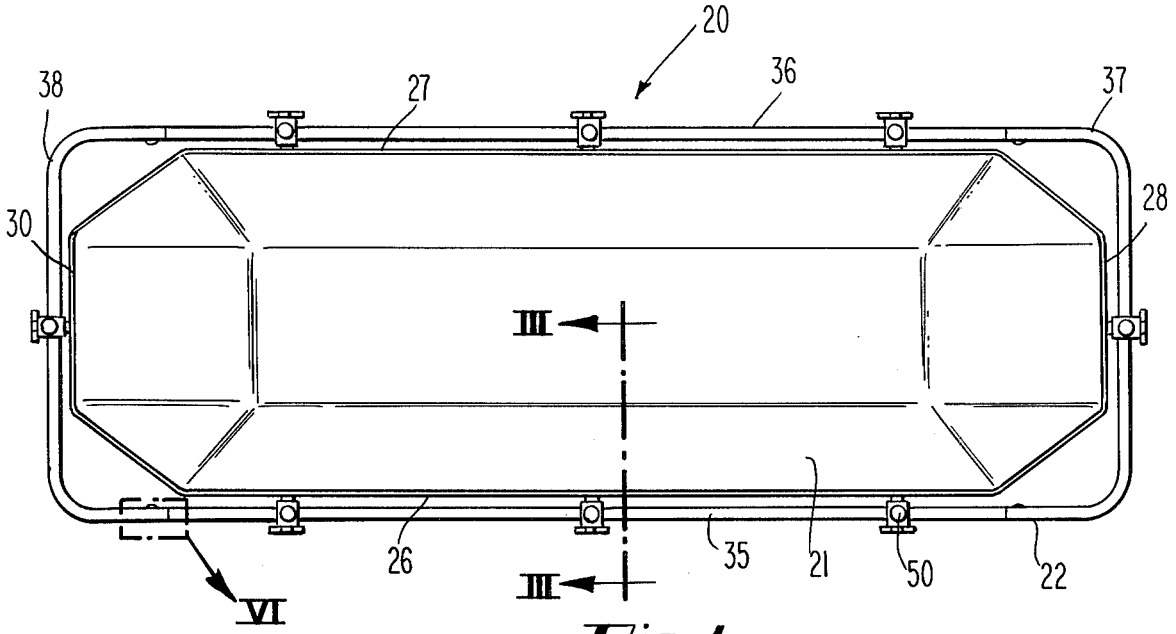
FIG. 1 is a top plan view of a casket and carrying structure in accordance with the present invention.

Referring now to the drawings in detail, reference is first made to FIG. 1, wherein the casket and carrying device is generally designated by the numeral 20, as comprising a handleless casket 21 and a carrying structure 22. The casket 21 has a tube portion 23 and a lid portion 24, attached by any conventional means (not illustrated) such as hinges or the like. The tub portion 24 is provided with a channel type elongated recess or groove 25 extending along the sides 26 and 27, and around the ends 28 and 30 thereof. The recess is clearly illustrated in FIGS. 3 and 5, for example, as being a channel-like indentation, adapted to receive projections therein. It will be noted that by making the recess continuous, as opposed to a discontinuous series of recesses, a preferred feature of adaptability of the casket for receiving engagement devices therein at any desired location is enabled, although it will be understood that a plurality of separate, discrete recesses may be utilized as desired, or even a plurality of ledges. It will be noted that the recess 25 is disposed as a continuation of a ledge 31 that protrudes outwardly beyond a lower casket wall portion 32. It will also be apparent that in some instances, the ledge alone will be sufficient for engagement by an engagement device, but in a preferred form, the channel-type recess 25 is highly desirable.

Figure 3:
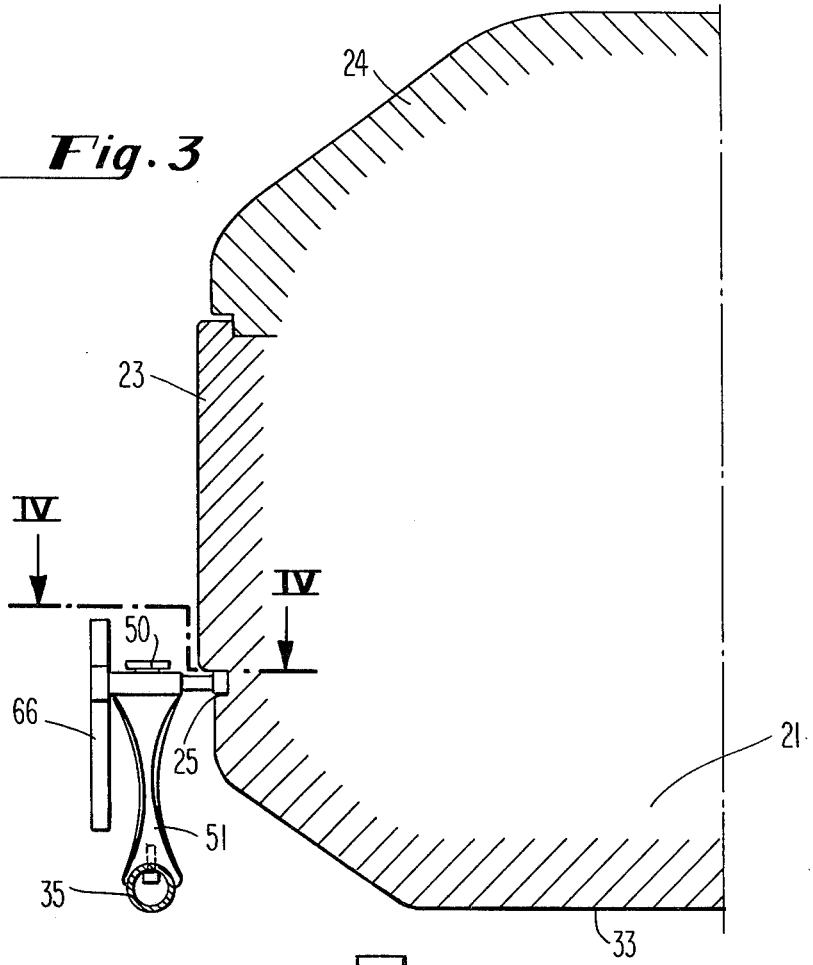
FIG. 3 is an enlarged fragmentary vertical sectional view, taken through a portion of the carrying structure and casket illustrated in FIG. 1, generally along the line III—III of FIG. 1.

It will further be noted that the recess 25 is disposed at a lower portion of the tub 23, for supporting the casket 21 at an elevated location, with bars of the casket support preferably located at about the same level as the bottom surface 33 of the casket (FIG. 3). It will, however, be further understood that the handle portions of the carrying structure may, if desired, be located somewhat higher than the bottom surface area 3 of the casket, when the carrying structure 22 is in engaged relation with a casket, in instances in which it may be desirable to be able to set the casket 21 down on a surface for ease of removal of the carrying structure 22. In other instances, it may be desirable to have a carrying structure 22 that functions not only as a carrying structure, but also as a support, for keeping the bottom surface 33 of the casket above the level of a given plane, such as above the level of a floor or table. In those instances, the handle portions of the carrying structure 22 will be disposed at a level lower than the surface 33 illustrated in FIG. 3.

Figure 2:
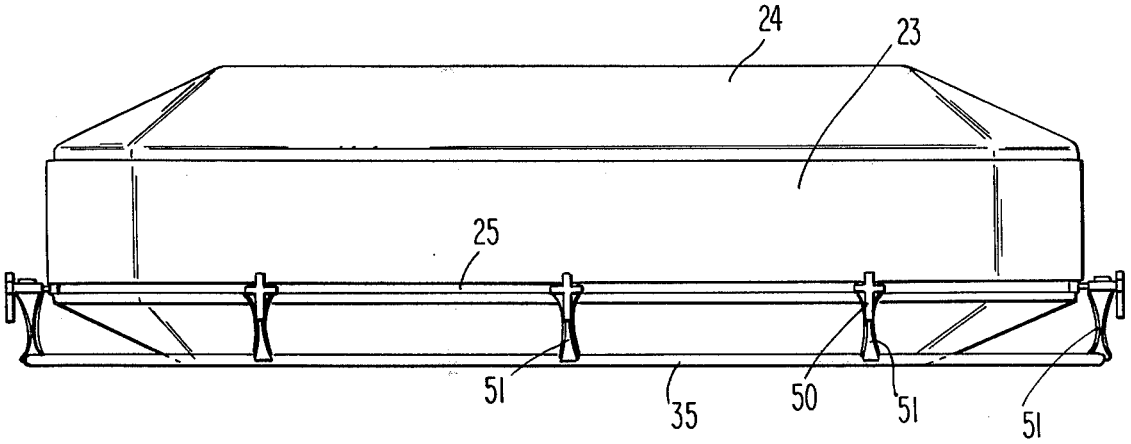
FIG. 2 is a front elevational view of the combination casket and carrying structure illustrated in FIG. 1.
Figure 6:
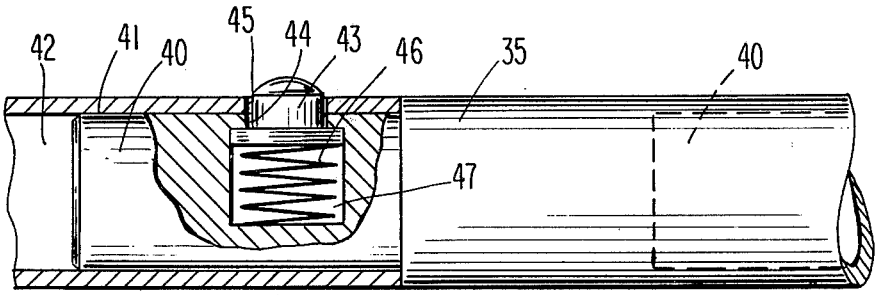
FIG. 6 is an enlarged detail view of that portion of the carrying structure of FIG. 1 indicated by VI, and wherein portions of the locking feature for connecting ends of the carrying structure to side portions thereof are more clearly illustrated.

The carrying structure 22 comprises a pair of side rails or bars 35, 36, preferably of tubular (hollow metal) construction. At ends of the casket 21, end portions 37 and 38 of the handle portion of the carrying structure 22 are of generally U-shaped configuration, but also are of tubular, preferably metal construction. The members 37 and 38 are connected to the side bars 35 and 36, as illustrated in FIG. 6, where it will be seen that the bar 35 is provided with a preferably substantially solid projection 40 of reduced diameter 41, protruding for a given distance beyond the end thereof, for receipt of the portion 40 within the end 42 of the member 38. A button 43 or like connecting member is spring-biased outwardly toward the position illustrated in FIG. 2, with the button 43 projecting through a hole 44 in member 40, and also projecting into a hole 5 in the member 38 that is aligned with the hole 44, for locking the members 35 and 38 together, as illustrated. It will be apparent that the button 43 may readily be manually depressed, compressing the spring 46 in its blind hole 47, for ease of dis-connection of the bar 38 from the bar 35. It will be understood also that, by this technique, the bars 35 and 36 may be replaced with longer or shorter bars, as may the bars 38 and 37 be replaced with narrower or wider bars, whereby a given number of bar components may be selected for accommodating caskets of various sizes, it being relatively easy to assemble a carrying structure 22 of a size that, when assembled, has interior dimensions sufficiently large to accommodate receipt of a casket therein, so that the carrying structure 22 will readily fit over the casket 21, as illustrated in plan in FIG. 1. Accordingly, versatility of the carrying structure is provided, as regards adaptability to size.

The carrying structure 22 is provided with a plurality of engagement devices 50 illustrated in FIG. 1, all of which are substantially identical, so that only one need be described in detail. It will first be noted that a plurality of risers 51 are provided fixedly secured to and extending upwardly from the various components 35 through 38 of the bar portion of the carrying structure 22, with each of the riser portions 51 being basically identical and supporting engagement devices 50 at their upper ends.

Figure 4:
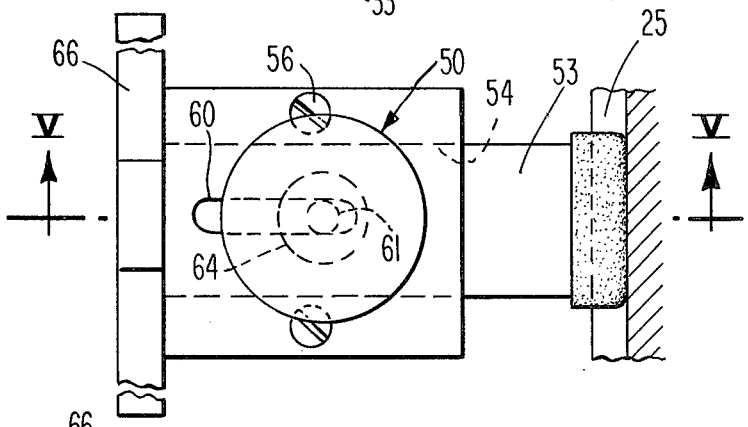
FIG. 4 is an enlarged view taken generally along the line IV—IV of FIG. 3, wherein the details of the engagement device illustrated in FIG. 3 are illustrated with greater clarity.
Figure 5:
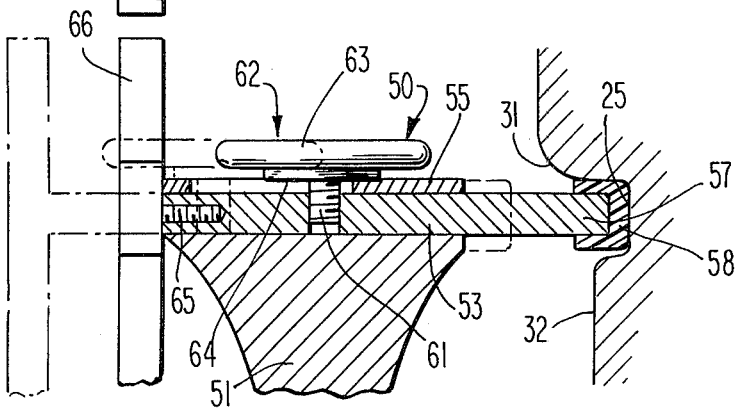
FIG. 5 is a vertical sectional view taken through the engagement device and fragmentary casket portion illustrated in FIG. 4, generally along the line V—V of FIG. 4, wherein the engaged and released positions of the engagement device are illustrated in full line and phantom positions, respectively.

With particular reference to FIGS. 3 through 5, it will be noted that a slide member 53 is provided, slideably received in a slideway 54 of a guide member 55 that in turn is threadedly attached by suitable screw-type fasteners 56 to the upper end of the riser 51, for accommodating transverse backward and forward movement of the projecting portion 57 of the guide member 53, between the full line and phantom positions therefor illustrated in FIG. 5. The projecting or engagement member 57 is provided with a preferably rubber bumper or the like 58 at its outer most end for engaging within a recess 25 in such a manner as not to mar the exterior of the casket 21.

A slotted hole 60 is provided in the upper surface of the guide 55, for accommodating a threaded member 61 of a locking device 62 that projects in sliding relation through the slotted hole 60, into threaded engagement with the guide 53 as illustrated in FIG. 5, and with the locking device 62 being provided with an enlarged head 63 that is manually graspable, for threaded turning, for facilitating locking and unlocking of a shoulder 64 thereof against the upper surface of the guide member 55, for securing the slide member 53 in a given desired position.

It will be noted that the left-most end of the guide member 53 is threaded at 65 for receiving an ornament 66 attached thereto, as illustrated in FIGS. 4 and 5, for covering the mechanism of the engagement device 50, and for providing ornamentation, generally of a religious type, as is commonly preferable for casket ornamentation. It will thus be seen that the engagement device 50 may be locked or unlocked for facilitating movement of the projecting portion 57 thereof into or out of engagement with a recess portion 25 of the casket 21, as desired.

Figure 7:
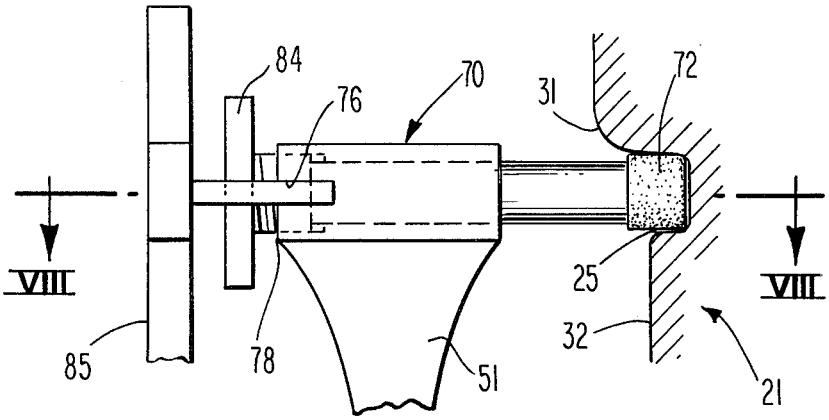
FIG. 7 is an enlarged fragmentary vertical sectional view of a modified form of an engagement device in accordance with the present invention, in engagement with the recess of a casket (fragmentally illustrated).
Figure 8:
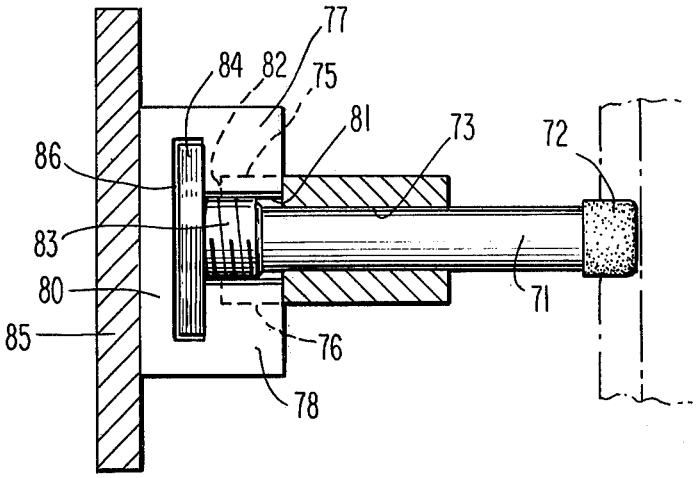
FIG. 8 is a horizontal sectional view of the device of FIG. 7, taken generally along the line VIII—VIII of FIG. 7.
Figure 9:
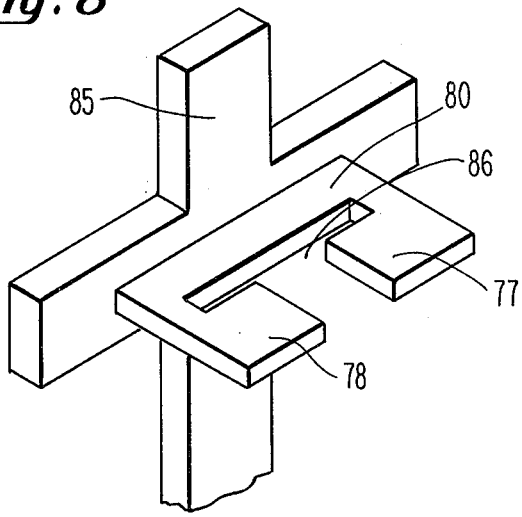
FIG. 9 is an enlarged fragmentary top perspective view of the rear side of an ornament and attached connecting structure, for connecting the ornament to the engagement device of FIGS. 7 and 8.

Referring now to the illustrations of FIGS. 7 through 9, an alternative embodiment of an engagement device is illustrated, generally designated by the numeral 70, as comprising a rod member 71 having a tip 72 of rubber or the like at its right-most end, as illustrated in FIG. 8 (to prevent marring of a casket with which it is engaged), with the rod member 71 being slideably received in a bore 73 of a guide member 74. The guide member 74 is generally cylindrical, and is provided with slotted cuts 75, 76 at its left-most end as viewed in FIGS. 7 and 8, that act as guideways for legs 77 and 78, respectively of the ornament guide 80 illustrated in FIG. 9.

The interior of the cylindrical or sleeve-like member 74 is internally threaded at the left-most end thereof as viewed in FIG. 8, at 81, for a predetermined distance from the end 82 thereof, to accommodate the threaded end 83 of member 71 therein. At the end of the threaded member 83, there is integrally provided a manually engageable, preferably knurled turning head 84, to facilitate manual engagement thereof and turning of the same, to screw the member 71 toward and away from the casket 21, by threading the threaded portion 83 into the threaded portion 81. It will be noted that the length of the legs 77 in the axial direction of the member 71 provides a movement limitation for inward movement of the engagement portion 71 of the device 70, but that the ornament 85 carried by the member 80 does not rotate with the head 84 as the head is rotated and the member 71 moves inwardly and outwardly, because the head 84 is free to rotate within the slot 86.

It will be apparent that various modifications may be made for the nut-like member 83, as well as for the rod 71, as well as in the manner of attachment of the ornament 85 to the member 84. It will further be understood that various modifications may be made to the engagement devices 50 and 70, in general, and that such devices are merely preferred forms of effecting engagements with a casket, in that other forms may also be utilized within the overall context of the present invention. It will further be understood that the telescopically engageable portions of the bars 35 and 38, for example of the carrying structure 22 may take on various forms that differ from the arrangement illustrated in FIG. 6, within the spirit and scope of the invention, and furthermore, that it may be desirable to utilize a carrying structure 22 that itself is not disassembleable into side members and end members as provided herein. It will further be apparent that various modifications may be made in general to the device of the present invention, as well as in the use and manufacture thereof, all within the spirit and scope of the invention as defined in the appended claims.

What is claimed is:

1. A casket comprising a tub portion and a lid portion, each of said tub portion and lid portion being free of any connected handles, said tub portion having generally upstanding walls and a bottom wall, and having engagement means integral with and completely around a lower portion of said upstanding walls, said engagement means comprising a u-shaped channel-like means for ready-detachably receiving portions of a normally separate reusable carrying structure in engagement therein.

2. A casket comprising a tube portion and a lid portion, each of said tub portion and lid portion being free of any connected handles, said tub portion having generally upstanding walls and a bottom wall, and having a recess means integral with a lower portion of said upstanding walls, said recess means comprising means for ready-detachably receiving portions of a normally separate reusable carrying structure in engagement therein, the carrying structure comprising bar-type frame means and a plurality of casket engaging devices carried thereby, said bar-type frame means comprising a tubular frame member disposed at the approximate level of said bottom wall of said casket, with a plurality of sequentially spaced apart riser members carried by said frame means, each of said riser members carrying said casket engaging device, said casket-engaging devices comprising, a slide member slidedly received in a guide member, with the guide members being carried at upper ends of said riser members, and locking means comprising threaded fastener means for locking said slide means in given selected positions of said guide members.

3. The combination of claim 2 including ornament means carried by said slide member.

4. A readily detachable reusable carrying structure for use in carrying a casket and for obviating the necessity of otherwise having handles on the casket, comprising bar-type frame means and a plurality of casket-engaging devices carried thereby, each said device having laterally moveable projecting means for adjustably projecting into engagement with engagement portions of a casket with which the structure is to be used, for engaging the same, and locking means for locking said projecting means in given selected positions.

5. The structure of claim 4, wherein said frame means comprises a tubular frame member with a plurality of sequentially spaced apart riser members carried by said frame means, each said riser member carrying a said casket-engaging device.

6. The structure of claim 5, wherein each said casket-engaging device comprises a slide member slidedly received in a guide member, with the guide members being carried at upper ends of said riser members, and locking means comprising threaded fastener means for locking said slide means in given selected position of said guide members.

7. The structure of claim 6, including ornament means carried by said slide means.

8. The structure of claim 4, wherein said frame means comprises tubular side members and tubular end members in telescopic engagement with said side members, including means for releasedly locking said side members and end members together in said telescopic engagement.

9. The structure of claim 4, wherein each said casket-engaging device comprises a threaded member in threaded engagement in a nut-like member, carrying a rod in sliding engagement in a bore, each said threaded member having an enlarged head thereon.

10. The structure of claim 9, wherein an ornament is carried by each said enlarged head in free rotative engagement in a slot of said ornament; and with guide portions of said ornament being in sliding engagement in associated said nut-like member.

11. A casket comprising a tub portion and a lid portion, each of said tub portion and lid portion being free of any connected handles, said tub portion having generally upstanding walls and a bottom wall, and having engagement means integral with a lower portion of said upstanding walls, said engagement means comprising means for ready-detachably receiving portions of a normally separate reusable carrying structure in engagement therein, the carrying structure having a frame means and a plurality of casket-engaging devices carried thereby, each of the devices having a slide member slidedly received in a guide member, the slide member adapted to engage said engagement means, and locking means comprising threaded fastener means for locking said slide means in selected positions.

12. The casket of claim 11, wherein the slide member is laterally moveable for adjustably projecting into said recess in engaged relation.

13. The casket of claim 11, wherein said engagement means comprises recess means.

14. The casket of claim 13, wherein said recess means is a channel that extends completely around the periphery of said tub portion.

15. The combination of claim 13, wherein said frame means comprising a tubular frame member disposed at the approximate level of said bottom wall of said casket, with a plurality of sequentially spaced apart riser members carried by said frame means, each said riser member carrying said casket-engaging device.

16. The combination of claim 13, wherein said frame means comprises tubular side members and tubular end members in telescopic engagement with said side members, including means for releasedly locking said side members and end members together in said telescopic engagement.

17. The combination of claim 13, said frame means being sized to define an internal opening greater than the external periphery of said casket, for facilitating passage of said frame means thereover.

18. The combination of claim 11, wherein each said casket-engaging device comprises a threaded member in threaded engagement with a nut-like member, carrying a rod in sliding engagement in a bore, each said threaded member having an enlarged head thereon.

19. The combination of claim 18, wherein an ornament is carried by each said enlarged head in free rotative engagement in a slot of said ornament; and with guide portions of said ornament being in sliding engagement in associated said nut-like member.

* * * * *

UNITED STATES PATENT OFFICE

CERTIFICATE OF CORRECTION

Patent No. 4,017,947 Dated April 19, 1977

Inventor(s) Hugh Collier Acton

It is certified that error appears in the above-identified patent and that said Letters Patent are hereby corrected as shown below:

Column 2, Line 32, "tube portion 23" should read --tub portion 23--;

Column 3, Line 21, "hole 5" should read --hole 45--;

Column 5, Line 14, "tube portion" should read --tub portion--.

Signed and Sealed this ninth Day of August 1977

[SEAL]

Attest:

RUTH C. MASON
*Attesting Officer*

C. MARSHALL DANN
*Commissioner of Patents and Trademarks*